US008029203B2

(12) United States Patent
Kase et al.

(10) Patent No.: US 8,029,203 B2
(45) Date of Patent: Oct. 4, 2011

(54) PRINTER FOR RECORDING IMAGES ON A RECORDING PAPER AND FEEDING THE PAPER BACKWARDS

(75) Inventors: Takaaki Kase, Tokyo (JP); Ichiro Furuki, Tokyo (JP); Akira Sakuta, Tokyo (JP); Akihito Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 737 days.

(21) Appl. No.: 12/091,624

(22) PCT Filed: Oct. 24, 2006

(86) PCT No.: PCT/JP2006/321126
§ 371 (c)(1),
(2), (4) Date: Apr. 25, 2008

(87) PCT Pub. No.: WO2007/049594
PCT Pub. Date: May 3, 2007

(65) Prior Publication Data

US 2009/0261140 A1 Oct. 22, 2009

(30) Foreign Application Priority Data

Oct. 26, 2005 (JP) ..... 2005-311163

(51) Int. Cl.
*B41J 15/00* (2006.01)

(52) U.S. Cl. ..... 400/613; 400/578; 400/583; 400/600; 400/611

(58) Field of Classification Search ..... 400/613, 400/120.01, 578, 583, 600, 611, 612; 271/9.1
See application file for complete search history.

(56) References Cited

U.S. PATENT DOCUMENTS 5,362,041 A * 11/1994 Ryuzaki et al. ..... 271/236
7,125,182 B2 * 10/2006 Campbell et al. ..... 400/613

FOREIGN PATENT DOCUMENTS

| | | |
|---|---|---|
| EP | 1 052 106 A2 | 11/2000 |
| JP | 61 4943 | 1/1986 |
| JP | 5-254293 | 10/1993 |
| JP | 2000 63018 | 2/2000 |
| JP | 2001-33889 | 2/2001 |
| JP | 2004 42669 | 2/2004 |
| JP | 2004 98696 | 4/2004 |
| JP | 2005 88305 | 4/2005 |

OTHER PUBLICATIONS

Machine Translation of JP 2005-088305.*

* cited by examiner

*Primary Examiner* — Matthew G Marini
(74) *Attorney, Agent, or Firm* — Oblon, Spivak, McClelland, Maier & Neustadt, L.L.P.

(57) ABSTRACT

A printing device provided with a conveyer roller pair for holding sheet paper drawn out from a recording paper roll to feed the sheet paper forward or backward. The device includes a feeding roller pair disposed between the recording paper roll and the conveyer roller pair for drawing out the recording paper and feeding it to the conveyer roller pair and a color recording unit disposed downstream of the conveyer roller pair in the direction of conveyance of the recording paper for recording a color image on the recording paper that is being moved backward. A guide unit with pivotable guide member is disposed between the feeding roller pair and the conveyer roller pair for bending and guides the recording paper in an arc-shape at an acute angle. A reservation space is provided outside of the arc-shaped recording paper guiding path for accommodating the sagged recording paper therein.

10 Claims, 6 Drawing Sheets

PRINTER FOR RECORDING IMAGES ON A RECORDING PAPER AND FEEDING THE PAPER BACKWARDS

TECHNICAL FIELD

This invention relates to a color thermal printer device for recording a full-color image on recording paper fed from a paper roll.

BACKGROUND ART

In the conventional color thermal printer, each color of yellow (Y), magenta (M) and cyan (C) is successively recorded on recording paper which is being alternatively conveyed back and forth to juxtapose the three colors to form a full color image.

Among many processes proposed to control conveying of recording paper in recording, there is a process for realizing both precision conveying and reducing the margins at the front and rear ends of the recording paper, in which a conveying roller pair for conveying the recording paper is disposed in the vicinity of the thermal head and upstream of a length of the recording paper feeding direction, and in which the recording paper fed from a recording paper roll is fed backward while being image-recorded by the thermal head, and in which the recording paper is cut into separate image frames by a cutter after the completion of the recording.

In this case, in the backward conveying operation in which the recording paper fed from the recording paper roll is to be drawn backward, since the bight portion of the recording paper is brought into contact with the recording paper conveying path and generates a fold in the recording paper, it was necessary that the recording paper roll be driven in the direction of drawing backward so that the supplied recording paper be taken up.

In order to solve this problem, a process is proposed to provide a loop formation portion between the recording paper roll and the conveyor roller pair for stocking the recording paper in the form of a loop and the recording paper is accommodated within the loop formation portion when the recording paper is to be drawn backward. Also, in addition to the above, a proposition is made to provide brake means for applying a braking force on the recording paper and a dancer roller for making a loop of the returned recording paper by a spring action so that, when the recording paper is to be fed backward, the recording paper roll is held by the brake means not to be rotated, whereby the dancer roller maintains the recording paper in a loop-shape within the loop formation portion (patent document 1).

[patent document 1] Japanese Patent Laid-Open No. 2004-45669, FIG. 2

DISCLOSURE OF INVENTION

Problems to be Solved by the Invention

In the proposition discussed in patent document 1 and in which the loop formation portion is provided between the recording paper roll and the conveyer roller pair, the backward feeding of the recording paper cause the recording paper to have a bight portion, which comes into contact with a component part, such as a feeding roller pair, a guide plate, a cutter, before it is introduced into the loop formation portion and the recording paper surface is damaged.

Further, in the arrangement in which the recording paper roll is provided with the brake means and the dancer roller is used to form the loop of the recording paper, the mechanism becomes complex and a fluctuation in the conveyance load on the recording paper is generated to degrade the record quality. In order to avoid the degrading of the record quality, it was necessary to achieve complex controlling of the tension on the recording paper to be kept constant.

This invention has been made to solve the above problems and has as its object the provision of a high precision, low cost, color printer device realizing a backward feeding of the recording paper with a simple mechanism and control and without generating damages such as scratches to the recording paper.

Measure for Solving the Problems

The printing device according to the present invention comprises, a recording paper roll, a conveyer roller pair for holding therebetween a sheet paper drawn out from the recording paper roll to feed the sheet paper forward or backward, a feeding roller pair disposed between said recording paper roll and said conveyer roller pair for drawing out the recording paper from the recording paper roll and feeding it to the conveyer roller pair, and a color recording unit disposed downstream of said conveyer roller pair in the direction of conveyance of said recording paper for recording an image in a plurality of colors on the recording paper that is being moved backward along the direction of conveyance, characterized in that a guide unit is disposed between said feeding roller pair and said conveyer roller pair for bending and guiding the recording paper in a substantially arc-shape so that an angle defined at a cross point between an extension of direction of feed of the recording paper from said feeding roller pair and an extension of direction of conveyance of the recording paper from said conveyer roller pair is an acute angle smaller than 90 degrees, a reservation space is provided outside of the arc-shaped recording paper guiding path for accommodating the sagged recording paper therein, said guide unit has provided at its side of the reservation space with a pivotally supported movable guide member. and that said reservation space for the recording paper is selectively opened or closed by the pivotal movement of said movable guide member.

Advantageous Results of the Invention

According to the present invention, when the recording paper is to be drawn backward, the printer device in which the bight portion of the recording paper is ensured to be accommodated within a reservation space provided adjacent to the outside of the bent recording paper guide path defined by a guide member and in which the generation of damages such as folds or scratches to the recording paper is prevented, whereby a high precision, low cost, color printer device realizing a backward feeding of the recording paper without generating deterioration such as scratches of the recording paper and with a simple mechanism and control is obtained.

BEST MODE FOR CARRYING OUT THE INVENTION

Embodiment 1

Figure 1:
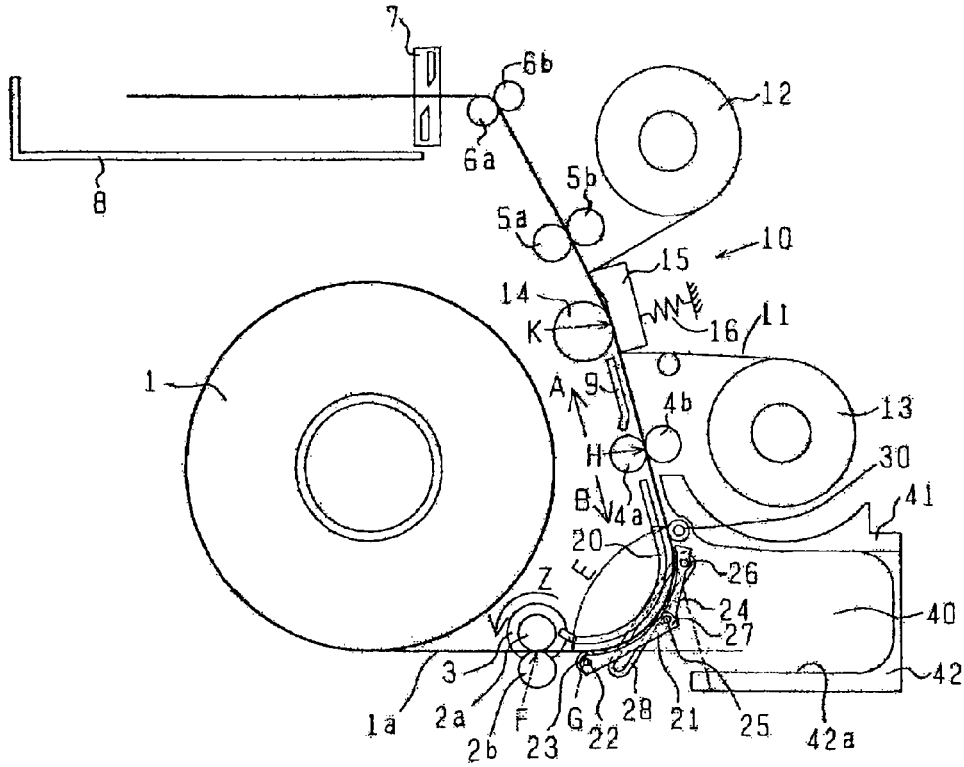
FIG. 1 is a structural view showing the main portion of a color printer device according to the first embodiment of the present invention.

FIG. 1 is a structural view showing the main portion of a color printer device according to the first embodiment of the present invention. In FIG. 1, 1 is a recording paper roll, which is rotatably supported by a shaft. 2*a* and 2*b* are a pair of feeding rollers, disposed at the downstream of the recording paper roll as viewed in the direction of conveying of the recording paper, for holding the recording paper 1*a* fed from the recording paper roll 1 therebetween to supply toward downstream in the direction of conveying of the recording paper. The feeding roller 2*a* is driven by an unillustrated drive source via a one way clutch 3. The one way clutch 3 transmits the rotational drive force only when it drives the feeding roller 2*a* in the direction of the arrow Z in the figure. The feeding roller 2*b* is freely rotatably supported and urged against the feeding roller 2*a*. 4*a* and 4*b* are a pair of conveying rollers, which are disposed downstream of the feeding roller pair 2*a*, 2*b*, for folding the recording paper 1*a* therebetween and supplying it toward the downstream of the recording paper conveying direction or drawing back toward upstream of the recording paper conveying direction. The conveying roller 4*a* is driven by an unillustrated drive source and the conveying roller 4*b* is freely rotatably supported by a shaft and urged against the conveying roller 4*a*.

On the downstream of the conveying roller pair 4*a*, 4*b* in the recording paper conveying direction, a color recording unit 10 is disposed. The color recording unit 10 comprises an ink sheet 11, an ink sheet feeder reel 12, an ink sheet take-up reel 13, a platen roller 14, a thermal head 15 and the like. The ink sheet 11 has painted inks of yellow (Y), magenta (M) and cyan (C) thereon in the named order and is wound on the ink sheet feeder reel 12 and taken-up by the ink sheet take-up reel 13. The ink sheet take-up reel 13 is driven by an unillustrated drive source in the direction for taking-up the ink sheet 11. The platen roller 14 is rotatably supported by a shaft. The thermal head 15 is urged against the platen roller 14 by a biasing means 16 and is supported for contacting with or separating from the platen roller 14.

5*a*, 5*b* are conveying rollers, disposed downstream of the color recording unit 10 as viewed in the recording paper conveying direction, for conveying the recording paper 1*a* toward downstream of the conveying direction by an unillustrated drive source. 6*a*, 6*b* are paper discharging rollers disposed downstream of the conveying rollers 5*a*, 5*b* as viewed in the recording paper conveying direction for discharging the recording paper 1*a* by an unillustrated drive source. 7 is a cutter for cutting the recording paper 1*a* at a predetermined length. 8 is a stacker for holding the cut recording paper 1*a* in a stack. 9 is a guide plate for the recording paper 1*a* disposed between the conveying roller 4*b* and the platen roller 14 for guiding the conveying of the recording paper 1*a*.

20 is a stationary guide disposed between the feeding roller pair 2*a*, 2*b* and the conveying roller pair 4*a*, 4*b* for guiding the recording paper 1*a* being conveyed and having an arc-shaped cross section. 21 is a movable guide A disposed in opposition to the stationary guide 20 with a gap therebetween for defining a conveying path for the recording paper 1*a* with in this gap, the movable guide A being pivotally supported by a shaft 22 from a frame or the like of the device main body. 23 is a guide roller pivotally supported by the shaft 22. 24 is a movable guide B disposed in opposition to the stationary guide 20 with a gap therebetween for defining a conveying gap for the recording paper 1*a* while the recording paper 1*a* is being conveyed and is pivotally supported by a shaft 25. The movable guide B24 has on its both side pins 26. 27 is a guide roller rotatably supported by the shaft 25. 28 is a guide rail fixed to a side plate 29 held by the device main body and has the pins 26 secure to both side faces of the movable guide B24 inserted therein. 30 is a guide roller pivotally supported at a position downstream of the movable guide B24 as viewed in the recording paper conveying direction.

The feeding roller pair 2*a*, 2*b*, the guide roller 23, the conveying rollers 4*a*, 4*b*, the platen roller 14 and the thermal head 15 are arranged such that the angle (shown by E) defined at a crossing point between a line connecting a point (shown by F) at which the feeding roller pair 2*a*, 2*b* holds the recording paper 1*a* to the upper surface (shown by G) of the guide roller 23 and a line connecting a point (shown by H) at which the conveying rollers 4*a*, 4*b* hold the recording paper 1*a* therebetween to a point (shown by K) at which the platen roller 14 contacts with the thermal head 15 is an acute angle smaller than 90 degrees, and that the stationary guide 20, the movable guide roller A21, the movable guide B24, the guide roller 23, the guide roller 27 and the guide rollers 30 causes the recording paper 1*a* fed from the feeding roller pair 2*a*, 2*b* to be bent in substantially arc-shaped configuration and guide it to the conveying roller pair 4*a*, 4*b*.

Figure 2:
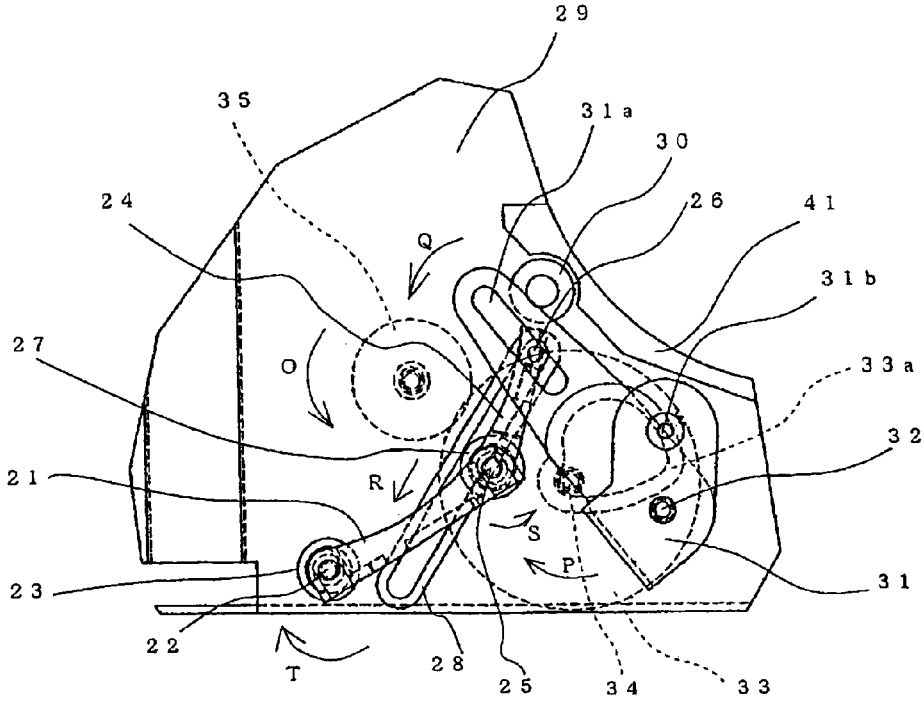
FIG. 2 is a main portion structural view showing the color printer device in the guide path formation state.
Figure 3:
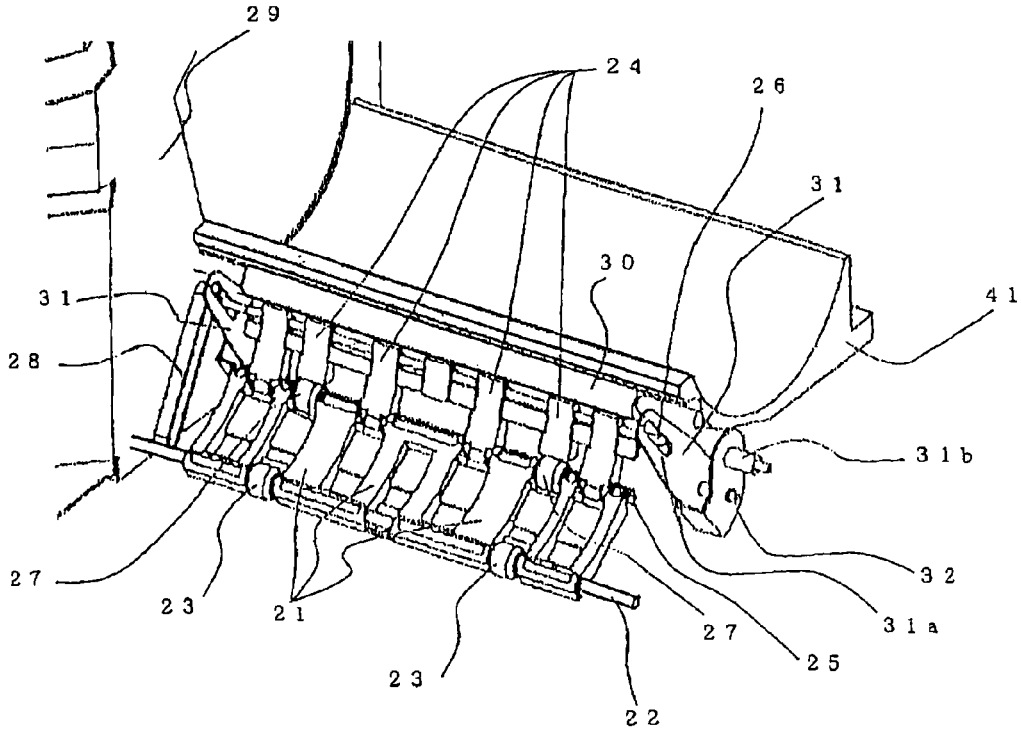
FIG. 3 is a main portion perspective view of the state shown in FIG. 2.
Figure 4:
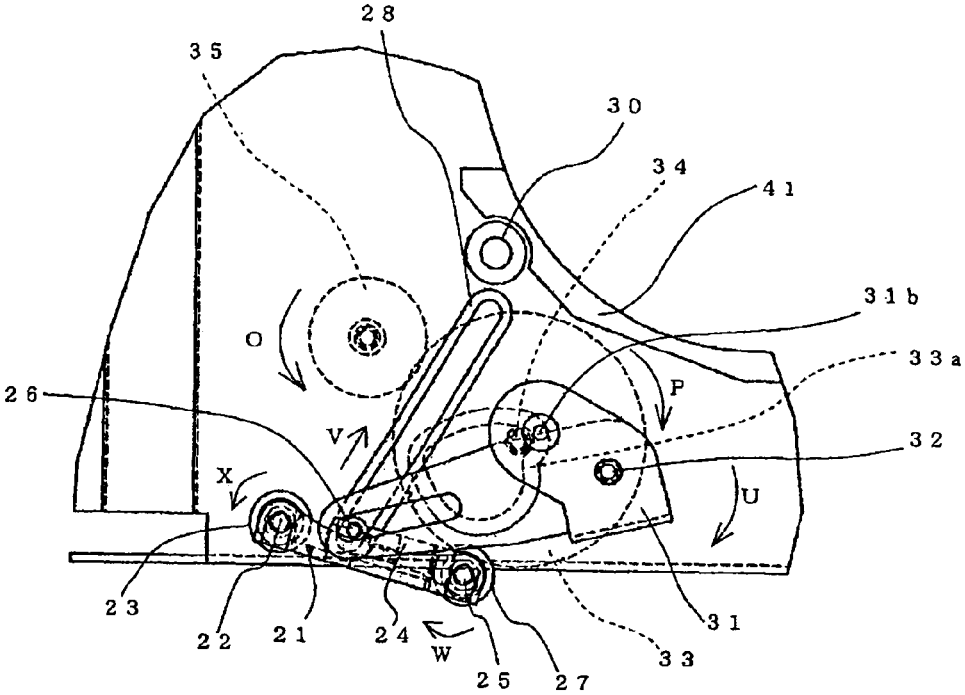
FIG. 4 is a main portion structural view showing color printer device in the guide path open state.
Figure 5:
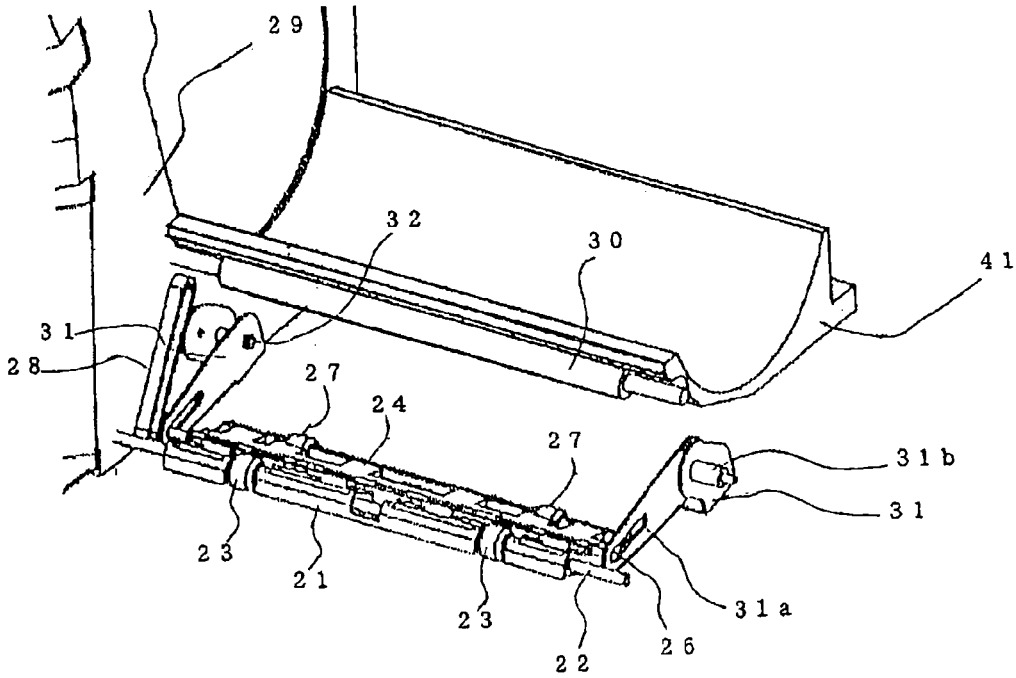
FIG. 5 is a main portion perspective view of the state shown in FIG. 4.

Next, the structure of the drive unit for the movable guide A21 and the movable guide B24 will now be described in conjunction with FIGS. 2 to 5. FIG. 2 is a main portion structural view showing the drive unit for the movable guide A21 and the like of the color printer device shown in FIG. 1, showing the state in which the movable guide A21 and the movable guide B21 defines the conveying guide path. FIG. 3 is a main portion perspective view of the state shown in FIG. 2. FIG. 4 is a main portion structural view showing the drive unit for the movable guide A21 and the like and showing the state in which the movable guide A21 and the movable guide B24 open the conveying guide path for the recording paper 1*a*. FIG. 5 is a main portion perspective view of the state shown in FIG. 4.

In the figures, 31 is an arm disposed at both sides of the movable guide A21 or the like and is pivotally supported by a shaft 32. Also, the arm 31 has formed therein an elongated hole 31*a* into which the pin 26 extending from the side face of the movable guide B24. Further, the arm 31 has secured thereto a pin 31*b*

33 is a cam gear, disposed on the arm 31 extended outside of the device and pivotally supported by a shaft 34. Also, the cam gear 33 has formed at its side face a cam groove 33*a* into which a pin 31*b* mounted to the arm 31 is inserted. 35 is a gear, meshing with the cam gear 33, which is driven in the direction of the arrow P shown in the figure by the unillustrated drive source.

40 is a reservation space for the recording paper 1*a*, which is defined by partition walls 41 and 42 and which, when the recording paper 1*a* is to be conveyed backward by the conveying roller pair 4*a*, 4*b*, is opened at its accommodation opening by the pivotal movements of the movable guide A21 and the movable guide B24 to accommodate the returned recording paper 1*a*.

Figure 6:
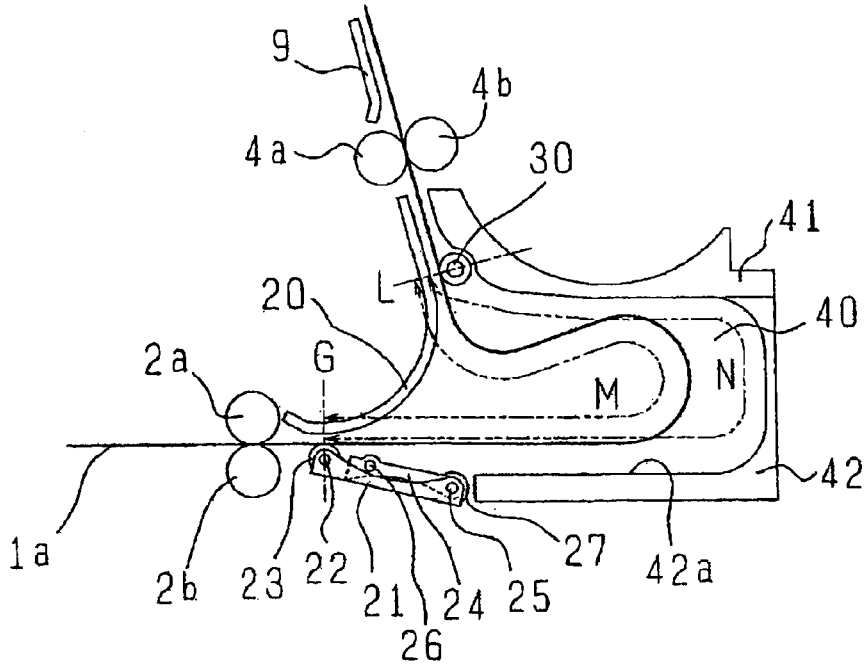
FIG. 6 is a main portion structural view showing the reservation space and its surroundings.

The reservation space 40 will now be described in conjunction with FIG. 6. FIG. 6 is a main portion structural view showing the reservation space 40 and its surroundings, the figure showing the state in which, the movable guide A21 and the movable guide B24 are pivoted by the operation which will be described later to open the accommodation opening of the reservation space 40 and the recording paper 1*a* is conveyed backward by a prescribed length. The reservation space 40 defined by the partition walls 41 and 42 is arranged so that N>M is held, where M is the length between the point G and the point L of the recording paper 1*a* due to the backward conveying, N is the length of the space between the point G and the point L along the inner wall of the partition walls 41, 42, and where G is the position at which the guide roller 23 contacts with the recording paper 1*a* and L is the position at which the guide roller 30 contacts with the recording paper 1*a*. It is desirable that the upper surface 42*a* of the lower inner wall of the partition wall 42 is lower than the guide rollers 27 rotatably supported by the movable guide B24 in the sate that the movable guide B24 is rotated and the accommodation opening of the reservation space 40 is opened.

The operation of Embodiment 1 will now be described in conjunction with FIGS. 1-10.

Figure 7:
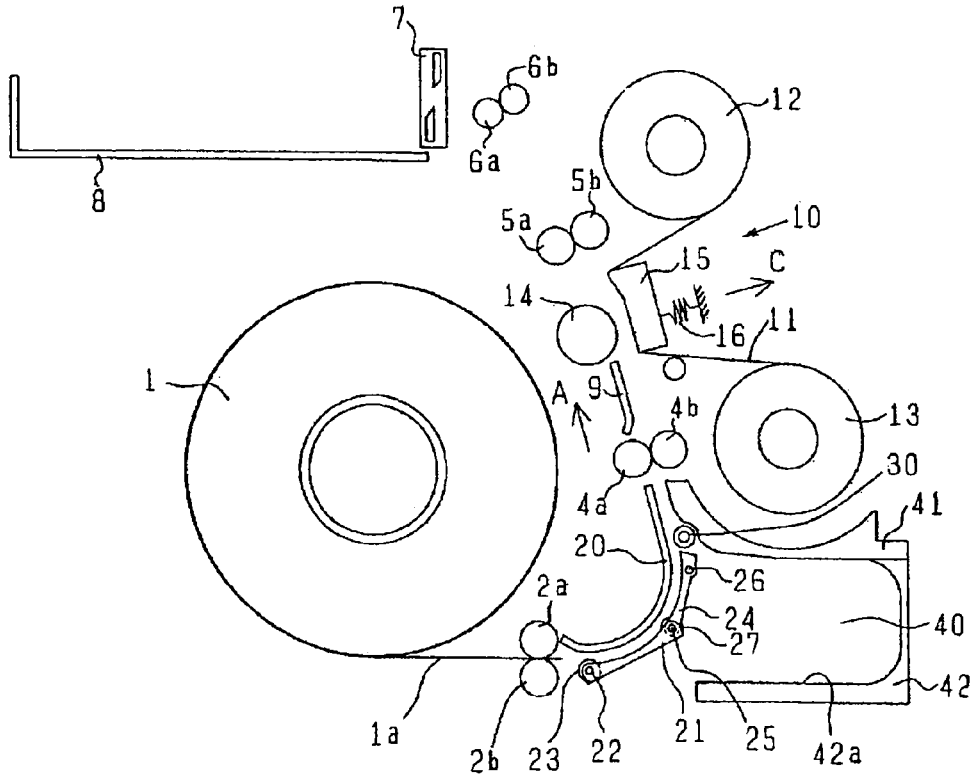
FIG. 7 is a main portion structural view showing the state in which the leading edge of the recording paper fed from the recording paper roll is held between the feeding roller pair.
Figure 8:
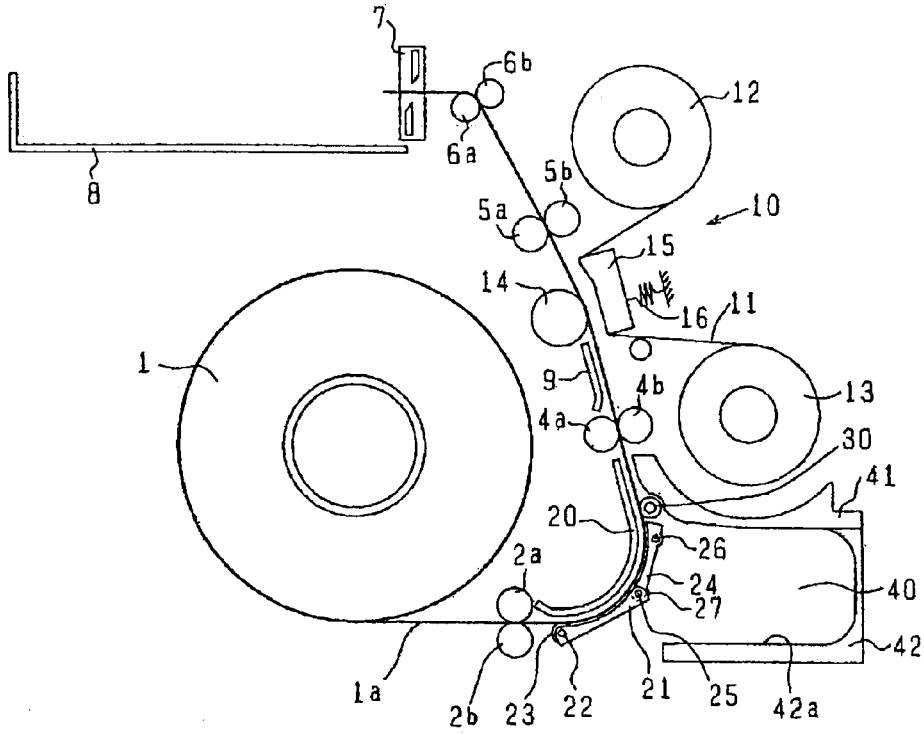
FIG. 8 is a main portion structural view showing the state in which the paper feeding is completed before recording.

First, the paper feeding operation will be described in terms of FIGS. 1, 7 and 8 When the recording paper la is to be set, as shown in FIG. 7, the thermal head 15 is moved in the direction of the arrow C shown in the figure by the unillustrated means to separate it from the platen roller 14. Then, the leading edge of the recording paper 1*a* fed from the recording paper roll 1 is held between the feeding roller pair 2*a*, 2*b*. In this state, as shown in FIG. 7, the movable guide A21 and the movable guide B24 close the reservation space 40 and provide the conveying guide path for the recording paper 1*a*. When the feeding roller 2*a* is rotated via the one-way clutch 3 to feed the recording paper 1*a*, the leading edge of the recording paper 1*a* is guided by the stationary guide 20, the guide roller 23, the movable guide A21, the guide roller 27, the movable guide B24 and guide roller 30 and held between the conveying roller pair 4*a*, 4*b*.

After the recording paper 1*a* is held between the conveyer roller pair 4*a*, 4*b*, the driving of the feeding roller 2*a* is interrupted and the conveyer roller 4*a* is rotated by the unillustrated drive source to convey the recording paper 1*a* in the direction of the arrow A shown in FIG. 1. Since the feeding roller 2*a* is connected to the unillustrated drive unit via the one-way clutch 3, the feeding roller 2*a* is permitted to rotate in the direction of the arrow Z shown in FIG. 1 due to the movement of the recording paper 1*a*, not impeding supplying of the recording paper 1*a* by the conveying rollers 4*a*, 4*b*.

When the recording paper 1*a* is conveyed by the conveying roller pair 4*a*, 4*b*, the one-way clutch 3 is in the idle state, and the rotational load from the unillustrated driving system for driving the feeding roller 2*a* does not act on the unillustrated drive system for driving the conveying roller 4*a*, so that the electric power-saving in terms of the unillustrated drive system for driving the conveying roller 4*a* can be realized. Also, the feeding roller 2*a* may be driven only when the recording paper roll 1 is to be set to the device and, once the recording paper 1*a* is held between the conveying roller pair 4*a*, 4*b*, there is no need to drive the feeding roller 2*a* even for the recording on the second or succeeding sheet, whereby the control can be simplified.

Simultaneously with the drive and the rotation of the conveying roller 4*a*, the conveying roller pair 5*a*, 5*b* and the discharging paper roller pair 6*a*, 6*b* are also driven and rotated by the unillustrated drive source. The leading edge of the recording paper 1*a* is guided by the guide plate 9 and the ink sheet 11, passes between the platen roller 14 and the thermal head 15 and the conveying roller pair 5*a*, 5*b*, the discharging roller pair 6*a*, 6*b* and the cutter 7 to be fed toward the stacker 8. After the distance from the position between the platen roller 14 and the thermal head 15 (position K in FIG. 1) to the leading edge of the recording paper 1*a* reaches to a predetermined length longer than the recording frame length of one image, the conveying roller 4*a*, the conveying rollers 5*a*, 5*b* and the discharging rollers 6*a*, 6*b* are ceased to be driven, to complete the feeding of the paper prior to recording, providing the state shown in FIG. 8.

After the completion of the feeding operation of the recording paper 1*a*, the operation is shifted to opening operation of the accommodation opening of the reservation space 40 and the preparation operation for the recording. These operations will be described in conjunction with FIGS. 1-5 and 9.

During the feeding, the movable guide A21 and the movable guide B24 are deployed as shown in FIGS. 2 and 3 and guide the conveyance of the recording paper 1*a*. When the gear 35 is driven and rotated in the direction of the arrow O shown in FIG. 2 by an unillustrated drive source, the cam gear engaged with the gear 35 is rotated in the direction of the arrow P shown in FIG. 2. The pin 31*b* attached to the arm 31 pivotally supported by the pivot shaft 32 is inserted into the cam groove 33*a* formed in the side face of the cam gear 33, so that the arm 31 rotates as the cam gear 33 rotates in the direction of the arrow Q shown in FIG. 2 about the pivot pin 32. Further, the pin 26 extended from the side surface of the movable guide B24 is inserted into the elongated hole 31*a* formed in the arm 31, so that the pin 26 extending from the movable guide B24 moves in the direction of the arrow R shown in FIG. 2 along the elongated hole in the guide rail 28 as the arm 31 rotates in the direction of the arrow Q shown in FIG. 2.

Figure 9:
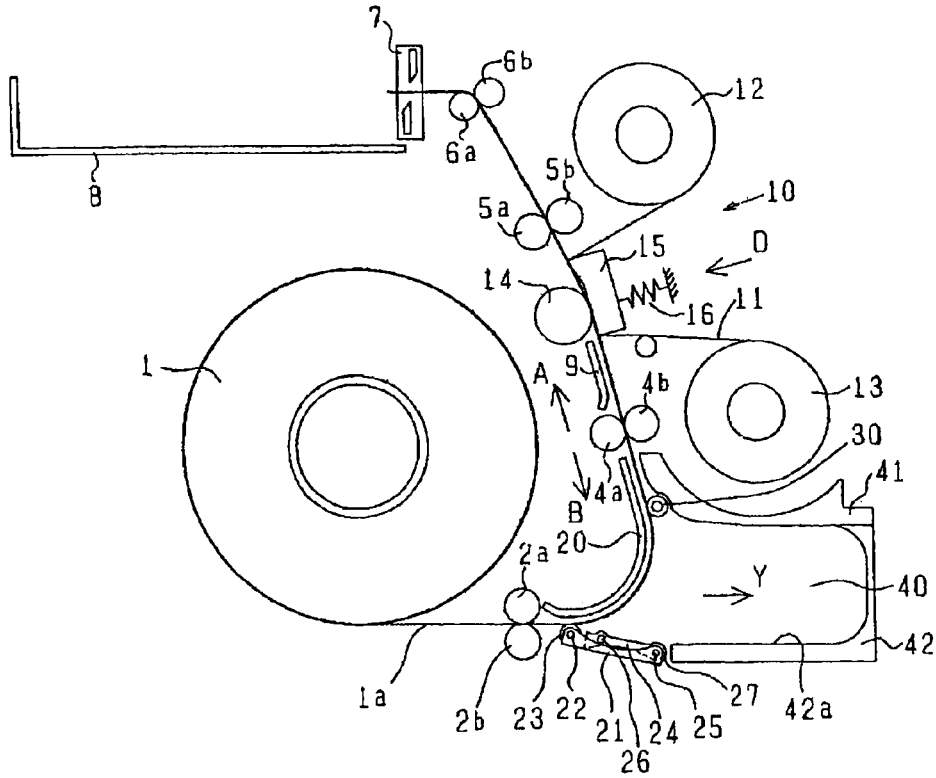
FIG. 9 is a structural view showing the recording preparation completed state.

The movable guide B24 is pivotally supported by the pivot pin 25 from the movable guide A21 and the movable guide A21 is pivotally supported by the pivot pin 22 from the unillustrated main body frame or the like, so that, as the pin 26 moves in the direction of the arrow R shown in FIG. 2, the movable guide B24 rotates about the pivot in 25 in the direction of the arrow S shown in FIG. 2 and the movable guide A21 rotates about the pivot pin 22 in the direction of the arrow T shown in FIG. 2 to reach to the state shown in FIGS. 4, 5 and 9.

When the gear 35 driven by the unillustrated drive source is stopped in this state, the accommodation opening for the reservation space 40 closed by the movable guide A21, the movable guide B24 and the like is opened. Then the ink sheet take-up reel 13 is rotated to feed the ink sheet 11 until the Y color reaches to the heating line (not shown) of the thermal head 15 and the rotation is ceased. Then the thermal head 15 is moved in the direction of the arrow D shown in FIG. 9 by unillustrated means, where the thermal head 15 is urged against the platen roller 14 via the ink sheet 11 and the recording paper 1*a*, thus the recording preparation is completed.

Next, the recording operation for the first color (Y color) will now be described in conjunction with FIGS. 1, 9 and 10. After the completion of the preparation of recording, shown in FIG. 9, the conveying roller 4*a* is driven to initiate the recording of the Y color by the thermal head 15 while the recording paper 1*a* is being drawn backward in the direction of the arrow B shown in FIG. 9. The Y color ink sheet 11 is supplied from the ink sheet feeding reel 12 and the ink sheet 11 after recording of the Y color is wound by the ink sheet take-up reel 13. The recording paper 1*a* is drawn backward in the direction of the arrow B shown in FIG. 9 by the conveying roller pair 4*a*, 4*b*, but since it is held by the feeding roller pair 2*a*, 2*b* that remains stationary, the recording paper 1*a* is held without being drawn backward toward the recording paper roll 1. The feeding roller 2*a* is connected to the unillustrated drive system via the one-way clutch 3, so that, when the feeding roller 2*a* is rotated in the direction opposite to the arrow Z shown in FIG. 1, the clutch of the one-way clutch 3 locks and the recording paper 1*a* can be held stationary by the load of the drive system.

The angle (shown by E in FIG. 1) defined between a line connecting the point (shown by F in FIG. 1) at which the feeding roller pair 2*a*, 2*b* holds the recording paper 1*a* in the conveying path for the recording paper 1*a* and the upper surface (shown by G in FIG. 1) of the guide roller 23 and a line connecting the point (shown by H in FIG. 1) at which the conveying rollers 4*a*, 4*b* hold the recording paper 1*a* therebetween and the contact point (shown by K in FIG. 1) at which the platen roller 14 contacts with the thermal head 15 is an acute angle smaller than 90 degrees, that is, the angle defined at a crossing point between an extension of the direction of conveying of the recording paper 1*a* by the feed roller pair 2*a*, 2*b* and an extension of the direction of conveying of the recording paper 1*a* by the conveying roller pair 4*a*, 4*b* is an acute angle smaller than 90 degrees, so that the horizontal component of the drive force in the direction of the arrow B shown in FIG. 9 by the conveying roller pair 4*a*, 4*b* is in the direction of the arrow Y shown in FIG. 9. Therefore, the recording paper 1*a* drawn back in the direction of the arrow B shown in FIG. 9 by the conveying roller pair 4*a*, 4*b* is moved in the direction of the arrow B shown in FIG. 9 while generating a bight portion and abut against the guide roller 27 and the lower surface 42*a* of the lower inner wall of the partition wall 42. After abutment, the recording paper 1*a* is prevented from moving further downward, so that, by the component in the direction of the arrow Y shown in FIG. 9 of the conveying force in the direction of the arrow B shown in FIG. 9, the bight portion 1*b* of the recording paper 1*a* expanded in the direction of the arrow Y shown in FIG. 9 and the bight portion 1*b* is accommodated within the reservation space 40.

Figure 10:
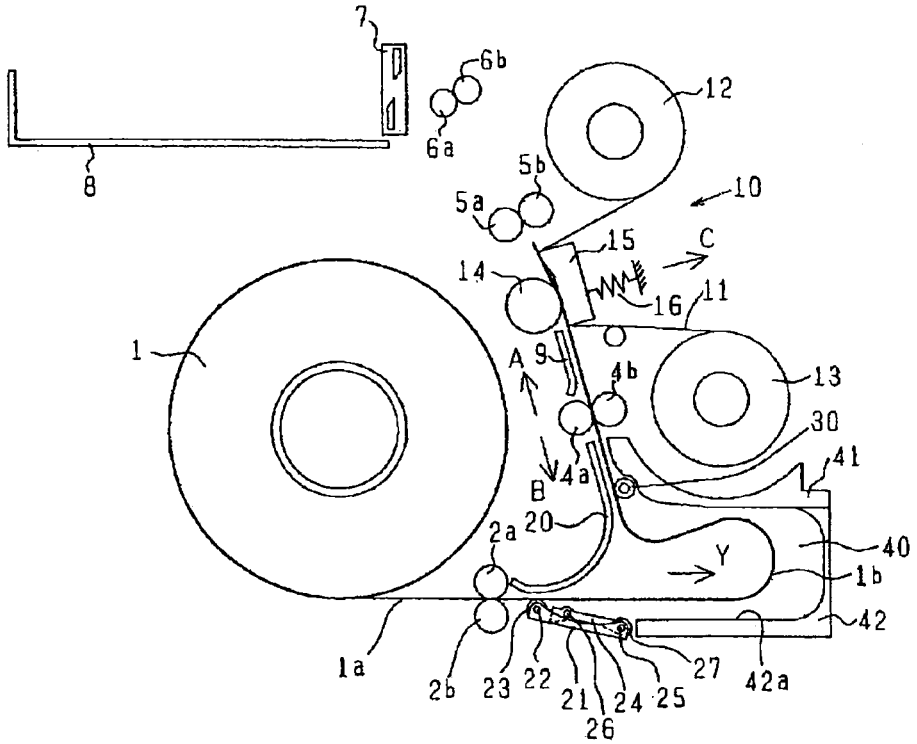
FIG. 10 is a main portion structural view showing the state in which the bight portion of the recording paper is accommodated within the reservation space.

After the completion of the recording of Y color in one whole image, the bight portion 1*b* of the drawn back recording paper 1*a* is accommodated in the reservation space 40 as shown in FIG. 10. The length of the inner wall of the partition walls 41, 42 defining the reservation space 40 is made larger than the drawing-back length of the recording paper 1*a*, so that the bight portion 1*b* of the recording paper 1*a* generates no fold within the reservation space 40. Also, since there is no fluctuation in the conveying resistance in drawing backward of the recording paper 1*a*, the degrading of the recording quality can be prevented. Also, the bight portion 1*b* of the recording paper 1*a* is contacted by the guide rollers 23, 27, the damages to the recording surface can be prevented.

After the completion of the Y color, the thermal head 15 is again moved in the direction of the arrow C shown in FIG. 10 by an unillustrated means to remove it from the platen roller 14. Then, by the unillustrated drive force, the conveying roller 4*a*, the conveying roller pair 5*a*, 5*b* and the discharging roller pair 6*a*, 6*b* are rotated to feed the recording paper 1*a* in the direction of the arrow A shown in FIG. 10. At this time, the recording paper 1*a*, which is fed from the bight portion 1*b* which has been drawn backward and held within the reservation space 40 during the Y color recording, is guided by the guide roller 30 and is prevented from being damaged at the recording surface. The leading edge of the recording paper 1*a* is guided by the guide plate 9 and the ink sheet 11, moved through between the platen roller 14 and the thermal head 15, passing through the conveying roller pair 5*a*, 5*b*, the discharging roller pair 6*a*, 6*b* and the cutter 7 to be supplied toward the stacker 8.

The feeding operation is stopped at the time point where the record initiation position on the recording paper 1*a* reaches between the platen roller 14 and the thermal head 15 (the position K shown in FIG. 1) and feeding of the record paper prior to the second color recording. Then, the thermal head 15 is moved in the direction of the arrow D shown in FIG. 11 by the unillustrated means, urging the thermal head 15 by the biasing means 16 against the platen roller 14 via the ink sheet 11 and the recording paper 1*a*, whereby the preparation of the recording is completed. Thereafter, similarly to the Y color recording operation, while the conveyer roller 4*a* is driven and the recording paper 1*a* is drawn backward in the direction of the arrow B shown in FIG. 11, the thermal head 15 achieves the M color recording. After the completion of the M color recording, an operation similar to that after the completion of the Y color recording is achieved, and after the recording paper 1*a* is discharged, the C color recording is achieved by the recording operations similar to those of the Y color and the M color, whereby the recording paper 1*a* is color-recorded.

After the completion of the color recording of one image, the recording paper 1*a* is conveyed to the stacker 8 through the conveying roller pair 4*a*, 4*b* and 5*a*, 5*b*, the discharging roller pair 6*a*, 6*b* as well as the cutter 7, which cuts the paper in a predetermined length and supplies it to the stacker 8, whereby the paper feeding operation for the next recording is completed.

It is to be noted that, except for the first paper feeding operation where the recording paper 1*a* is supplied to the conveying roller pair 4*a*, 4*b* by the feeding roller pair 2*a*, 2*b*, the movable guide A21, the movable guide B24 and the like maintain the state in which the accommodation opening of the reservation space 40 is opened as shown in FIGS. 4 and 5. This is similar where the recording is shifted to the recording of the second and subsequent pages. Also, the feeding roller 2*a* needs not to be driven at the time of shifting to the recording of the second and subsequent pages, realizing a simplified control.

When the recording paper roll 1 is to be replaced where the recording paper in the recording paper roll 1 is completely consumed, for example, the movable guide A21 and the movable guide B 24 are deployed and to formulate the guide path for the recording paper 1*a* by the operations discussed below. These operations will be explained in terms of FIGS. 2-5. As described above, at the time of recording, the movable guide A21 and the movable guide B 24 are folded as shown in FIGS. 4 and 5 to open the accommodation opening of the reservation space 40. When the gear 35 is driven and rotated in the direction of the arrow O shown in FIG. 4 by the unillustrated drive source, the gear 33 that meshes with the gear 35 is rotated in the direction of the arrow P shown in FIG. 4. The cam groove 33*a* formed in the side face of the cam gear 33 have inserted therein the pin 31*b* disposed on the arm 31 pivotally supported by the pivot pin 32, so that the arm 31 is rotated in the direction of the arrow U shown in FIG. 4 about the pivot pin 32 as the cam gear 33 rotates.

Further, since the elongated hole 31*a* formed in the arm 31 has inserted therein the pin 26 extending from the side face of the movable guide B24 and the pin 26 is inserted into the elongated hole formed in the guide rail 28 fixed to the side plate, the pin 26 extended from the movable guide B24 moves in the direction of the arrow V shown in FIG. 4 along the elongaged hole of the guide rail 28 as the arm 31 rotates in the direction of the arrow U shown in FIG. 4. The movable guide B24 is pivotally supported on the movable guide A21 by the pivot pin 25, and the movable guide A21 is pivotally supported on the unillustrated main body frame or the like by the pivot pin 22, so that, as the pin 26 moves in the direction of the arrow V shown in FIG. 4, the movable guide B24 rotates in the direction of the arrow W shown in FIG. 4 about the pivot pin 25 and the movable guide A21 rotates in the direction of the arrow X shown in FIG. 4 about the pivot pin 22 to provide the state shown in FIGS. 2 and 3. When the driving of the gear 35 by the unillustrated drive source is ceased in this state, the movable guide A21 and the movable guide B24 and the like close the accommodation opening of the reservation space 40 to provide the guide path for the recording paper 1*a*. After this, the recording paper 1*a* is set on the device and the feeding roller pair 2*a*, 2*b* feeds the recording paper 1*a* to the conveying roller pair 4*a*, 4*b* for the paper feeding operation.

As has been described, a stationary guide 20 is disposed between the feeding roller pair 2*a*, 2*b* and the conveyer roller pair 4*a*, 4*b* for bending and guiding the recording paper 1*a* in a substantially arc-shape so that an angle defined at a cross point between an extension of direction of feed of the recording paper 1*a* from the feeding roller pair 2*a*, 2*b* and an extension of direction of conveyance of the recording paper 1*a* from the conveyer roller pair 4*a*, 4*b* is an acute angle smaller than 90 degrees, and the movable guide A21 and the movable guide B24 are disposed in opposition to the stationary guide 20 so that a gap providing the conveying path for the recording paper 1*a* is defined therebetween, and the reservation space 40 is provided outside and in the neighbor of the arc-shaped recording paper guiding path defined by the guide members for accommodating the bight portion of the recording paper 1*a* therein, and the movable guide A21 and the movable guide B24 are pivotally supported to enable the reservation space 40 to be selectively opened or closed, and the arrangement is such that, when the forward feeding of the recording paper 1*a* drawn out from the recording paper roll 1 to the conveyor roller pair 4*a*, 4*b* by the feeding roller pair 2*a*, 2*b* is to be achieved, the movable guide A21 and the movable guide B24 close the accommodation opening of the reservation space 40 to form the recording paper guiding path for guiding the conveyance of the recording paper, and when the recording paper 1*a* is to be conveyed backward by the conveyer roller pair 4*a*, 4*b*, the feeding rollers 2*a*, 2*b* is ceased to be driven to hold the recording paper 1*a* and the movable guide A21 and the movable guide B24 are rotated to open the recording paper accommodating opening of the reservation space 40, so that, when the recording paper 1*a* is to be conveyed backward the bight portion 1*b* generated in recording paper 1*a* is ensured to be accommodated within said reservation space 40, whereby the generation of damages such as folds and scratches of the recording paper 1*a* can be prevented.

Also, the feeding roller 2*a* is arranged to be rotated via the one-way clutch 3, so that, once the drive control has been achieved only when the recording paper is fed by the feeding roller pair 2*a*, 2*b* to the conveying roller pair 4*a*, 4*b* with the recording paper roll 1 set in the printer device, there is no need to carry out the drive control, realizing a simple control and power saving, and when the recording paper 1*a* is to be drawn backward by the conveying rollers 4*a*, 4*b*, the feeding roller pair 2*a*, 2*b* reliably holds the recording paper 1*a*, so that the bight portion 1*b* generated in the recording paper 1*a* while the recording paper 1*a* is being drawn backward can be accommodated within the reservation space 40 without fail, ensuring that the generation of the folds or scratches of the recording paper 1*a* is prevented.

Also, the rotatable guide member is constituted by the plurality of guide members 21, 24, so that the reservation space 40 that does not damage the bight portion 1*b* of the recording paper 1*a* can be obtained.

Also, the guide roller 27 is coaxially disposed with the rotational shaft 25 of the movable guide A21 and the movable guide B24, so that, during guiding the recording paper 1*a* upon paper feeding, the damages of the recording paper 1*a* by the joint portion of the guide members can be prevented and the damages of the recording paper 1*a* during accommodating the bight portion 1*b* within the reservation space 40 can be prevented.

Also, the length of the reservation space 40 in the direction of conveying of the recording paper 1*a* is made larger than the length of the one frame of an image, so that the bight portion 1*b* is prevented from being folded within the reservation space 40 and no fluctuation is generated in conveying resistance during the drawing of the recording paper 1*a* backward, thus preventing the degrading of the recording quality.

Also, the guide roller 30 is disposed downstream of the movable guide B24 as viewed in the direction of recording paper conveying, so that the recording surface is prevented from being scratched when the recording paper 1*a* is supplied from the reservation space 40.

Embodiment 2

In the above embodiment 1, an example is described in which the recording paper 1*a* is drawn backward by the conveying roller pair 4*a*, 4*b* after it is fed, but in this embodiment 2, an example will be described in which, before the recording paper 1*a* is drawn backward by the conveying roller pair 4*a*, 4*b*, the recording paper 1*a* is fed by a small amount by the feeding roller pair 2*a*, 2*b* and then the recording paper 1*a* is drawn backward.

The constitution is similar to that of the above embodiment 1, so that the operation will be described in conjunction with FIGS. 9 and 11. FIG. 9 shows the state in which the recording preparation as described in connection with the above embodiment 1 is completed and the operations up until this state is similar to those in the above embodiment 1.

Before initiation of the recording, the feeding roller 2*a* is driven to rotate it to feed the recording paper 1*a* by a small amount by the feeding roller pair 2*a*, 2*b*. The feeding by the feeding roller pair 2*a* causes the recording paper 1*a* generates a bight in the direction of the arrow Y shown in FIG. 11 to become a state shown in FIG. 11. The rotation of the feeding roller 2*a* is ceased in this state and the recording paper 1*a* is held by the feeding roller pair 2*a*, 2*b*.

Figure 11:
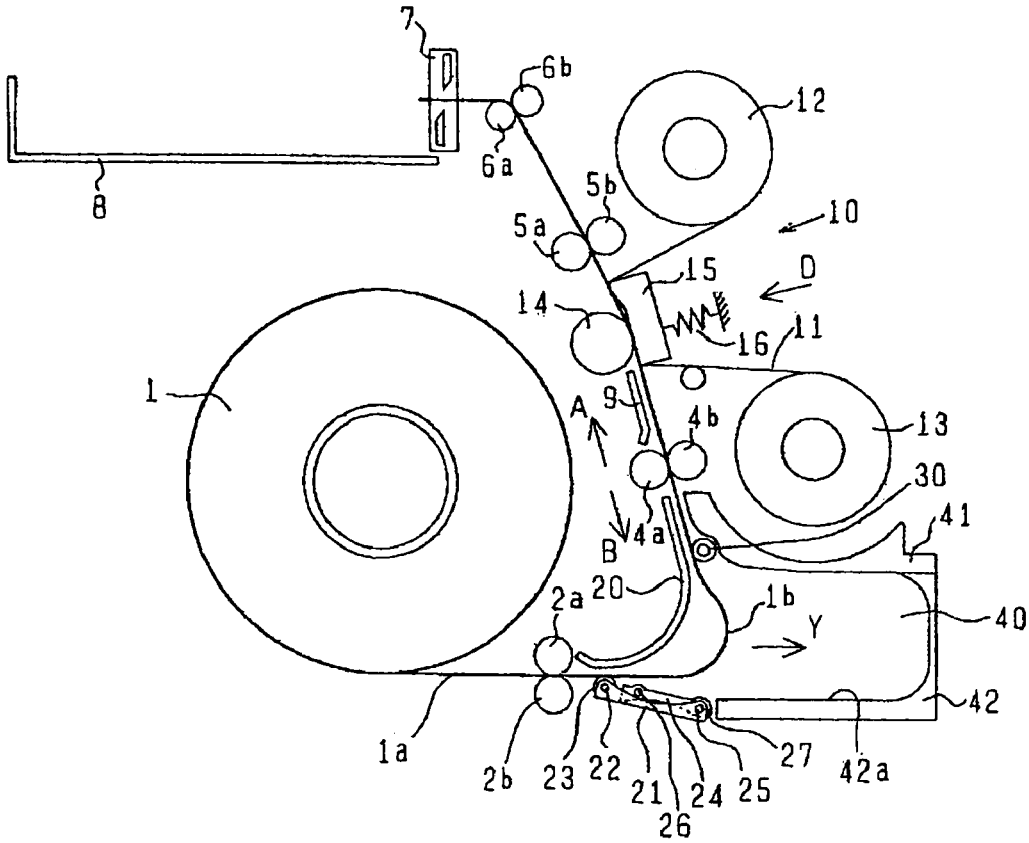
FIG. 11 is a structural view showing the main portion of the color printer device according to the second embodiment of the present invention.

Then, similarly to the above embodiment 1, the recording paper 1*a* is drawn backward in the direction of the arrow B shown in FIG. 11 by the conveying roller pair 4*a*, 4*b*, then the recording paper 1*a* moves in the direction of growing the bight portion 1*b* that is already generated, thus the bight portion 1*b* of the recording paper generated by the drawing-backward operation is ensured to be stably accommodated within the reservation space 40. The recording operation and other operations are similar to those in the above embodiment 1, so that their description will be omitted.

As has been described, a stationary guide 20 is disposed between the feeding roller pair 2*a*, 2*b* and the conveyer roller pair 4*a*, 4*b* for bending and guiding the recording paper 1*a* in a substantially arc-shape so that an angle defined at a cross point between an extension of direction of feed of the recording paper 1*a* from the feeding roller pair 2*a*, 2*b* and an extension of direction of conveyance of the recording paper 1*a* from the conveyer roller pair 4*a*, 4*b* is an acute angle smaller than 90 degrees, and the movable guide A21 and the movable guide B24 are disposed in opposition to the stationary guide 20 so that a gap providing the conveying path for the recording paper 1*a* is defined therebetween, and the reservation space 40 is provided outside and in the neighbor of the arc-shaped recording paper guiding path defined by the guide members for accommodating the bight portion of the recording paper 1*a* therein, and the movable guide A21 and the movable guide B24 are pivotally supported to enable the reservation space 40 to be selectively opened or closed, and the arrangement is such that, when the forward feeding of the recording paper 1*a* drawn out from the recording paper roll 1 to the conveyor roller pair 4*a*, 4*b* by the feeding roller pair 2*a*, 2*b* is to be achieved, the movable guide A21 and the movable guide B24 close the accommodation opening of the reservation space 40 to form the recording paper guiding path for guiding the conveyance of the recording paper, and when the recording paper 1*a* is to be conveyed backward by the conveyer roller pair 4*a*, 4*b*, the movable guide A21 and the movable guide B24 are rotated to open the accommodation opening of the reservation space 40 and the feeding roller pair 2*a*, 2*b* is stopped to hold the recording paper 1*a* therebetween after the recording paper 1*a* is fed by a small amount by the feeding roller pair 2*a*, 2*b* to form a bight portion 1*b* in the recording paper 1*a*, and the recording paper 1*a* is conveyed backward by the conveying rollers 4*a*, 4*b*, so that, when the recording paper 1*a* is to be conveyed backward the bight portion 1*b* generated in recording paper 1*a* is ensured to be accommodated within the reservation space 40, whereby the generation of damages such as folds and scratches of the recording paper 1*a* can be prevented.

While both of the above embodiments show examples where the rotation of the feeding roller 2*a* is stopped after the recording paper 1*a* is conveyed to the conveying roller pair 4*a*, 4*b* by the feeding roller pair 2*a*, 2*b*, when the recording paper 1*a* is to be conveyed in the direction of the discharging of the recording paper 1*a*, the arrangement may be such that the feeding roller 2*a* is kept rotating to convey the recording paper 1*a* by both of the feeding roller pair 2*a*, 2*b* and the conveying roller pair 4*a*, 4*b* and that the rotation of the feeding roller 2*a* is stopped only when the recording paper 1*a* is drawn backward.

Also, in any of the above embodiments, the reservation space 40 for the recording paper 1*a* is defined by the partition walls 41 and 42, but the reservation space 40 may be defined by the frame or the like of the device.

Also, in any of the above embodiments, one pair of the conveying rollers 5*a*, 5*b* and one pair of the discharging rollers 6*a*, 6*b* are disposed downstream of the color recording unit 10, but the roller pair to be disposed downstream of the color recording unit is not limited to these rollers.

INDUSTRIAL APPLICABILITY

This invention is applicable to a color thermal printer device for recording a full color image on the recording paper in the form of a roll and capable of providing a high precision, low cost, color printer device realizing a backward feeding of the recording paper with a simple mechanism and control and without generating damages such as scratches to the recording paper.

The invention claimed is:

1. A printing device comprising;

a recording paper roll;

a conveyer roller pair that holds therebetween a sheet paper drawn out from the recording paper roll to feed the sheet paper forward or backward;

a feeding roller pair disposed between said recording paper roll and said conveyer roller pair and that draws out the recording paper from the recording paper roll and feeds it to the conveyer roller pair; and a color recording unit disposed downstream of said conveyer roller pair in the direction of conveyance of said recording paper that records an image in a plurality of colors on the recording paper that is being moved backward along the direction of conveyance, wherein a guide unit is disposed between said feeding roller pair and said conveyer roller pair and bends and guides the recording paper in a substantially arc-shape, wherein an angle defined at an intersection between i) an extension of direction of feed of the recording paper from said feeding roller pair and ii) an extension of direction of conveyance of the recording paper from said conveyer roller pair to said color recording unit is an angle smaller than 90 degrees, a reservation space is provided outside of the arc-shaped recording paper guiding path, which reservation space accommodates a bight portion of the recording paper therein, said guide unit includes a pivotally supported movable guide member; and said reservation space is selectively openable and closable by the pivotal movement of said movable guide member.

2. A printing device as claimed in claim 1, wherein the arrangement is configured such that, after the recording paper drawn out from the recording paper roll is held by said feeding roller pair, said feeding roller pair forward feeds the recording paper to said conveyor roller pair with said movable guide member closing a recording paper accommodating opening of said reservation space to form a recording paper guiding path that guides the conveyance of the recording paper, and backward feeding of the recording paper by said conveyer roller pair is achieved with said feeding roller pair stopped, and said movable guide member rotated to open the recording paper accommodating opening of said reservation space, and with the recording paper conveyed backward by said conveying roller pair to be accommodated within said reservation space.

3. A printing device as claimed in claim 1 or 2, wherein backward feeding of the recording paper by said conveyer roller pair is achieved with said feeding roller pair stopped after the recording paper is fed by a small amount from the recording paper roll by said feeding roller pair, and said movable guide member rotated to open the recording paper accommodating opening of said reservation space, and with the recording paper conveyed backward by said conveying roller pair to be accommodated within said reservation space.

4. A printing device as claimed in claim 1, wherein said feed roller pair is rotated via a one-way clutch.

5. A printing device as claimed in claim 1, wherein said movable guide member is composed of a plurality guide elements pivotally coupled to each other.

6. A printing device as claimed in claim 1, wherein a guide roller is coaxial with a rotation axis of said movable guide member.

7. A printing device as claimed in claim 1, wherein a length of an inner wall of said reservation space in the direction of conveyance of the recording paper is larger than a length of one image to be recorded on the recording paper.

8. A printing device as claimed in claim 1, wherein a guide roller is disposed downstream of said movable guide member in the recording paper conveying direction.

9. The printing device as claimed in claim 1, wherein the color recording unit is disposed directly above the guide unit.

10. The printing device as claimed in claim 9, wherein the guide unit is disposed below a level of a center of the recording paper roll.

* * * * *